United States Patent [19]

Horton

[11] Patent Number: 5,051,027

[45] Date of Patent: Sep. 24, 1991

[54] BOAT LIFT

[76] Inventor: George F. Horton, 3224 Parks Rd., Benton, La. 71006

[21] Appl. No.: 451,089

[22] Filed: Dec. 15, 1989

[51] Int. Cl.[5] ..... B63C 3/06

[52] U.S. Cl. ..... 405/3; 114/44; 254/338

[58] Field of Search ..... 405/1-7; 114/44, 45, 48, 51, 258, 259; 414/678; 254/334-338

[56] References Cited

U.S. PATENT DOCUMENTS

| | | | |
|---|---|---|---|
| 735,569 | 8/1903 | Nelssen | 114/45 |
| 983,957 | 2/1911 | Trantham | 254/338 |
| 2,529,948 | 11/1950 | Jones | 405/3 X |
| 3,661,415 | 5/1972 | Piasecki | 254/337 X |
| 3,697,048 | 10/1972 | Sarno | 254/148 |
| 4,109,896 | 8/1978 | Ragen | 254/144 |
| 4,329,082 | 5/1982 | Gillis | 114/48 X |
| 4,686,920 | 8/1987 | Thomas | 405/3 |

FOREIGN PATENT DOCUMENTS

| | | | |
|---|---|---|---|
| 273163 | 3/1930 | Italy | 114/45 |

*Primary Examiner*—Dennis L. Taylor
*Assistant Examiner*—John Ricci
*Attorney, Agent, or Firm*—Arthur F. Zobal

[57] ABSTRACT

The Boat Lift has two support rods with a lower pulley connected to each end of each support rod. An upper pulley and a winding device with a ratchet are located above each lower pulley. Four cords and a winch are provided. Each cord has one end connected to one winding device and extends downward around its associated lower pulley; upward around its upper pulley; and has its other end coupled to the winch. Operations of the winch lowers and raises the support rods. The ratchets and winding devices are employed to allow the two support rods to be leveled.

7 Claims, 2 Drawing Sheets

BOAT LIFT

BACKGROUND OF THE INVENTION

1. Field of the Invention

The invention relates to an apparatus for lifting and lowering a boat from and into the water.

2. Description of the Prior Art

U.S. Pat. Nos. 4,109,896 and 3,697,048 disclose different types of boat hoists.

SUMMARY OF THE INVENTION

It is an object of the invention to provide a new and effective apparatus for lifting and lowering a boat from and into the water and which is easy to install and to operate.

It is another object of the invention to provide a boat lift having support means for supporting a boat and an apparatus for readily leveling the support means.

The lifting and lowering apparatus comprises four lower pulleys adapted to be connected to the support means at spaced apart positions sufficient to allow a boat to be received between two pairs of the lower pulleys. Four upper pulleys are adapted to be coupled above the four lower pulleys respectfully. A winch is provided for operating four flexible cords. Each cord has one end adapted to be coupled in place above one of the lower pulleys and extends downward around its associated lower pulley; upward around its associated upper pulley; and has its other end coupled to the winch.

The apparatus for allowing the support means to be leveled comprises a winding means controllable by a ratchet and adapted to be located above each lower pulley. The end of each cord is connected to its associated winding means whereby the cord may be wound around or from its winding means to allow the support means to be leveled.

In the preferred embodiment, each upper pulley and winding means is coupled to a sleeve and two such sleeves are fitted around opposite ends of a support rod with two such support rods secured in place in parallel relationship at an upper level.

DESCRIPTION OF THE PREFERRED EMBODIMENTS

Figure 1:
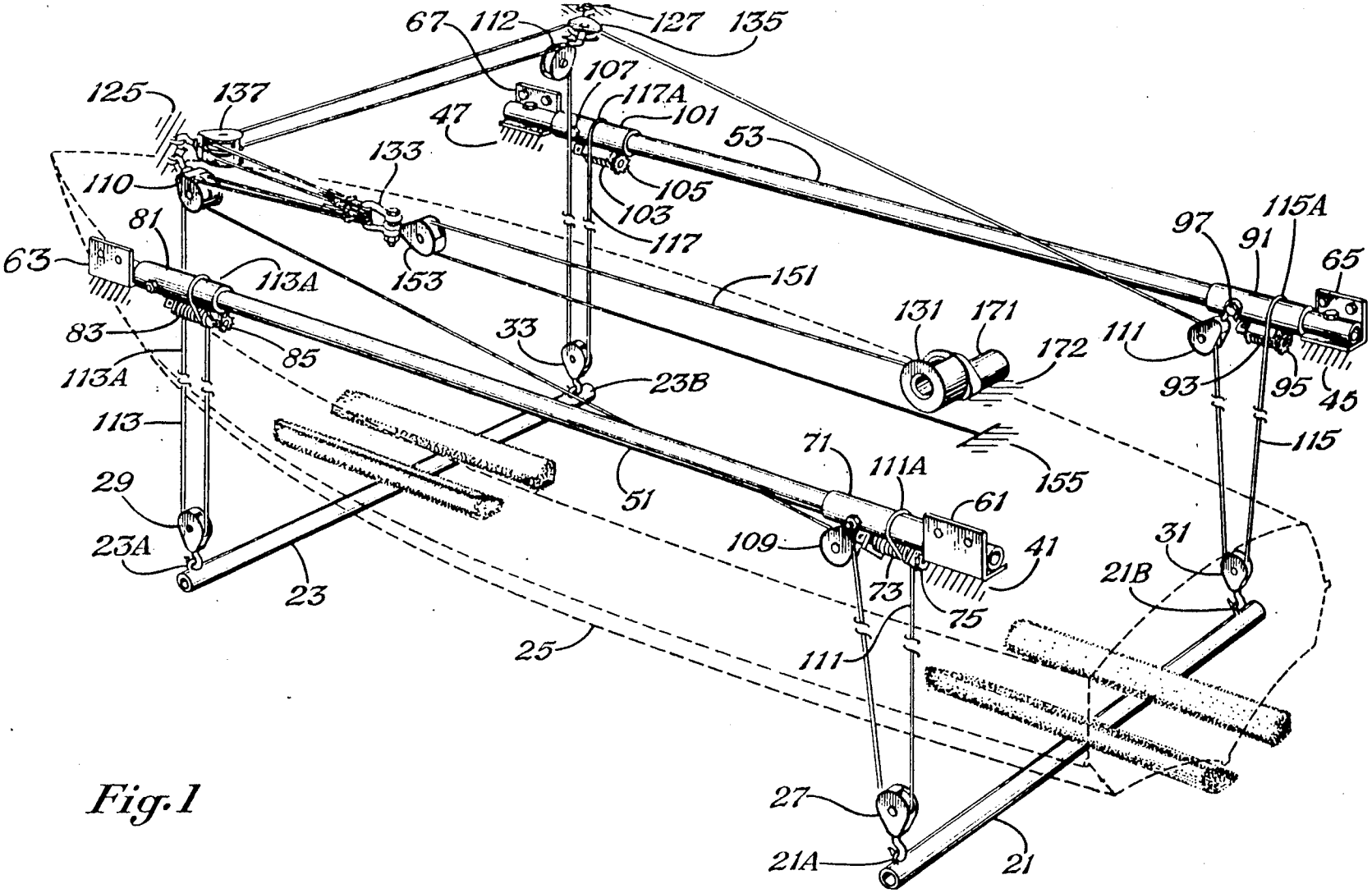
FIG. 1, schematically illustrates the invention.

Referring now to FIG. 1 of the drawings, the apparatus of the invention comprises two elongated metal pipe supports 21 and 23 for supporting the bottom of a boat illustrated in dotted line at 25. Support member 21 has two eyelets 21A and 21B at opposite ends to which the hooks of two lower pulleys 27 and 31 are removably coupled. Support member 23 has two eyelets 23A and 23B at opposite ends to which the hooks of two lower pulleys 29 and 33 are removably coupled. The pulleys 27 and 31 and 29 and 33 are spaced apart such that a boat may be received between the pulleys 27 and 31 and 29 and 33.

Secured to stationary upper support structure, 41, 43, 45, and 47 are two elongated cylindrical metal members 51 and 53. The opposite ends of the cylindrical members 51 and 53 are secured to brackets 61, 63, 65, and 67 by bolts which in turn are secure to the support structure 41, 43, 45, and 47 by bolts. The support structure 41, 43, 45, and 47 may be vertical pipes or pilings driven or embedded in the ground below the water level and extending upward to the positions shown. Fitted around the ends of the elongated members 51 and 53 are cylindrical metal sleeves 71, 81, 91, and 101. The sleeves are secured to the elongated members 51 and 53 by welding as illustrated at 102 in FIGS. 2 and 3. Coupled to each of the sleeves 71, 81, 91, and 101, are a winding means, and a ratchet. The winding means are illustrated at 73, 83, 93, and 103. A ratchet wheel of a ratchet is connected to each of the winding means. The ratchet wheels are illustrated at 75, 85, 95 and 105. The pawls of the ratchets are not shown in FIG. 1, however, one such pawl is shown at 209 in FIGS. 2, 3, and 4. The sleeves 71, 81, 91 and 101 have outward extending necks with bolt heads for receiving and supporting the hooks of upper pulleys. Necks with bolt heads (hook supporting members) are shown at 97 and 107 on sleeves 91 and 101.

In FIG. 1 the hooks of upper pulleys 109 and 111 are removable coupled around the hook supporting members of the sleeves 71 and 101 respectively such they are located above pulleys 27 and 31. Upper pulleys 110 and 112 located above pulleys 29 and 33 respectively are removably coupled to upper stationary structures 125 and 127 above the pulleys 29 and 33 although they could be coupled to the necks of the bolt heads (hook supporting members) of the sleeves 81 and 101 above the pulleys 29 and 33.

Four flexible cords 111, 113, 115, and 117 of rope or wire strand have ends secured to the four winding means respectively and extend downward and around their associated lower pulleys and upward and around their associated upper pulleys and to a winch 131. In this respect, the upper end IIIA of the cord 111 is secure to the winding means 73 and extends downward and around the pulley 27, upward and around the pulley 109, around the dual pulley 110 and then is connected to a U-Bolt 133. The upper end 115A of cord 115 is attached to the winding means 93, and extends downward around the pulley 31 and upward and around the pulley 111, around the pulley 135, to the side and around the dual pulley 137 and to the U-Bolt 133 to which it is connected. The upper end 113A of the cord 113 is connected to the winding means 83 and extends downward and around the pulley 29 upward and around the pulley 110 and then to the U-Bolt 133 to which it is connected. The upper end 117A of the cord 117 is connected to the winding means 103 and extends downward around the pulley 33, upward and around the pulley 112 to the side around the pulley 137 and to the U-Bolt 133 to which it is connected. Pulleys 135 and 137 are removably secured to stationary structures 127 and 125 respectively. A flexible cord 151 has one end connected to the winch 131 and then around a pulley 153 which is connected to the U-Bolt 133 and to stationary support structure 155 which is secured to the support structure 41, 43, 45, and 47.

The winch 131 is driven by an electric motor 171 and gear mechanism. The motor 171 is secured by bolts (not shown) to stationary support structure 172 which is secured to structure 41, 43, 45, and 47. The motor 171 may be operated in opposite directions to rotate the winch 131 in opposite directions to raise and lower the supports of 21 and 23 and hence the boat. To raise the supports 21 and 23, the motor 171 is operated in one direction to rotate the cord 151 around the winch in a direction to pull the support members 21 and 23 upward. The motor 171 is rotated in an opposite direction to allow the winch to be rotated in an opposite direction to allow the cord 151 to be unwound from the winch to lower the supports 21 and 23 to a position below the water line to remove from or to load a boat on the supports 21 and 23. Adjacent ends of the supports 21 and 23 may be connected together if desired.

Figure 4:
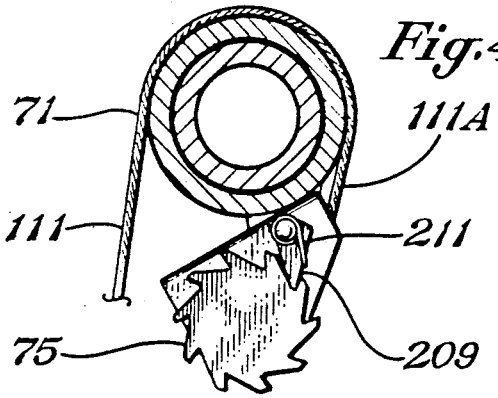
FIG. 4 is a cross-section of FIG. 3 taken along the lines 4—4, thereof.
Figure 5:
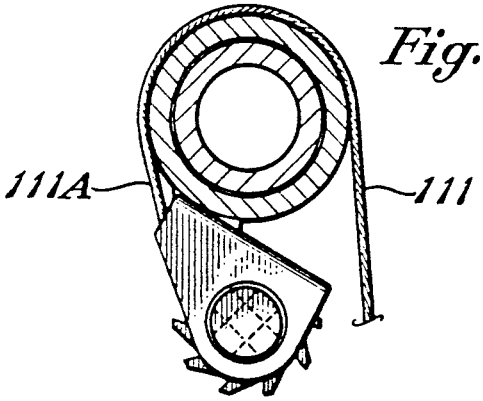
FIG. 5 is a cross-section of FIG. 3 taken along the lines 5—5 thereof.
Figure 2:
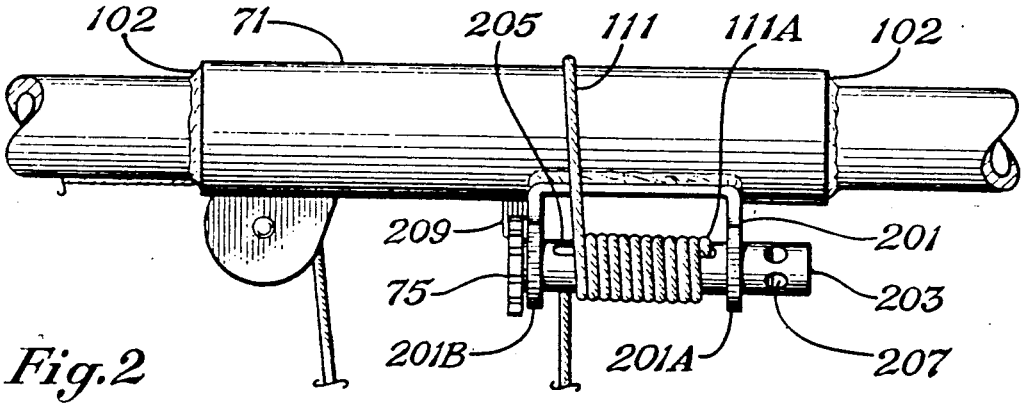
FIG. 2 is a side view of an apparatus component of the invention comprising a sleeve for supporting a pulley and a winding means and a ratchet.
Figure 3:
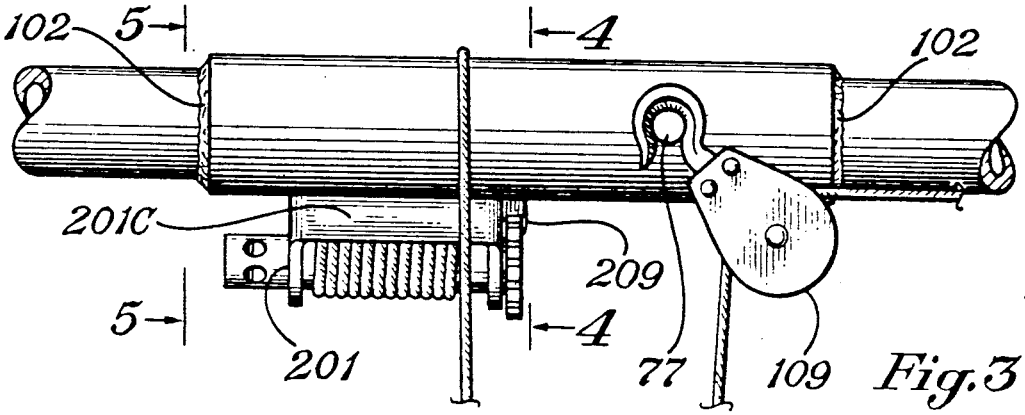
FIG. 3 is an opposite side view the apparatus of FIG. 2.

The ratchets of wheels 75, 85, 95, 105, and their winding mechanisms 73, 83, 93, and 103, are employed to allow the support members 21, and 23 to be leveled. Referring to FIG. 2 and 3, the winding mechanism 73 shown comprises a U-member 201 secured to the sleeve 21 by welding. It has two holes extending through its arms 201A and 201B through which a rotatable winding rod 203 extends. Winding rod 203 has a slot 205 from therethrough. One end of the rod 203 has a ratchet wheel 75 connected thereto which cooperates with a pawl 209 biased by a spring 211. Normally the pawl 209 allows the ratchet wheel 75 to rotate in only one direction (clockwise as shown in FIG. 4) to prevent the weight of or on the support rod 21 from unwinding the cord 111 from the winding rod 203. The sleeve 71 is secured to the tubular member 51 such that the open side of the U-shaped member 201 faces outward as shown in FIG. 1. By open side is meant the side opposite the connecting member 201C. The cord 111 has its end IIIA located and tied in the slot 205 and then is wound around the winding rod 203 a certain amount and then over and around the sleeve 71. If the end of the support rod 23 below the winding mechanism 73 is not level, the pawl can be manually removed from the teeth of the ratchet wheel 75 when there is no weight on the support rod 23 and the winding rod 203 rotated in either direction by the operator to level the end of the support rod 23 below the winding mechanism 203. Rotation of winding rod 203 may be carried out by inserting a lever through one of the apertures 207 formed through the end of the winding rod 203 and rotating the rod 203 with the lever.

The sleeves 81, 91, and 101 each have a winding means, ratchet, and a hook supporting member for holding an upper pulley as disclosed by the apparatus of FIGS. 2 and 3. In FIG. 3, the neck of the bolt head for holding the pulley 109 is shown in cross-section at 77. The sleeves 81 and 91 and 101 are secured to tubular members 51 and 53 respectively such that the open sides of their U-shaped members face outward. In FIGS. 2 and 3, the ratchet wheel 75 and pawl are shown facing in the direction of the hook receiving member 77, however, they may be reversed in position as shown in FIG. 1.

The use of the sleeves 71, 81, 91, and 101 with a winding means, ratchet and a hook supporting member for holding an upper pulley has advantages since they can be preassembled and then fitted around the ends of tubular members 51 and 53 and secured thereto by welding or the use of bolts. Although not shown in FIG. 1, preferably the upper pulleys 110 and 112 will be coupled to the sleeves 81 and 101 respectively by way of their hook supporting members.

Preferably each of the sleeves 71, 81, 91 and 101 will be formed or cast as a single unit with their U-shaped members 201 for supporting their ratchet and their hooks supporting members being inlegral with the sleeve.

I claim:

1. An apparatus for lifting and lowering a boat from and into the water, comprising:

support means for receiving and supporting a boat.

four lower pulleys adapted to be connected to said support means at spaced apart positions sufficient to allow a boat to be received between two pairs of said lower pulleys, four winding means adapted to be supported above said four lower pulleys respectively each of which is adapted to be rotated in opposite directions, a ratchet provided for each winding means, each ratchet comprising a ratchet wheel connected to its associated winding means and a pawl for normally allowing its ratchet wheel to rotate in only one direction four upper pulleys adapted to be supported above said four lower pulleys respectively, winch means adapted to be supported in place and adapted to be rotated in opposite directions, four flexible cords, each cord having one end adapted to be connected to one of said winding means with each cord extending downward and around its associated lower pulley, upward around its associated upper pulley, and with its other end adapted to be coupled to said winch means whereby said winch means may raise said support means when rotated in one direction and lower said support means when rotated in an opposite direction, each of said ratchets being controllable to allow its associated winding means to be rotated in opposite directions to wind or unwind its associated cord around or from its associated winding means to allow said support means to be leveled.

2. The apparatus of claim 1, wherein:

said four winding means are supported above said four lower pulleys respectfully, said four upper pulleys are supported above said four lower pulleys respectfully, said winch means is supported in place.

3. The apparatus of claim 1, comprising:

four support members, each of said support members having one of said winding means and ratchets connected thereto and means for coupling one of said upper pulleys thereto.

4. The apparatus of claim 3, comprising:

two elongated rod members, each rod member being adapted to be secured in place to support structure and adapted to have two of said support members connected thereto at spaced apart positions.

5. The apparatus of claim 4, wherein:

each of said rod means is secured and placed to support structure and has two of said support members connected thereto at spaced apart positions.

6. The apparatus of claim 4, wherein:

said four support members comprise hollow cylindrical members, said two elongated rod members comprise two elongated cylindrical members, each of said elongated cylindrical members being adapted to have two of said hollow cylindrical members fitted around and secured to opposite end thereof.

7. The apparatus of claim 6, wherein:

each of said elongated cylindrical members is secured in place to support structure and has two of said hollow cylindrical members fitted around and secured to opposite ends thereof.

* * * * *